US005913725A

United States Patent [19]

Goldring

[11] Patent Number: 5,913,725

[45] Date of Patent: Jun. 22, 1999

[54] SECURE MAILER/RECEIPT BUSINESS FORM

[75] Inventor: Tony Steven Goldring, Victoria, Australia

[73] Assignee: Moore U.S.A. Inc., Grand Island, N.Y.

[21] Appl. No.: 08/875,777

[22] PCT Filed: Nov. 15, 1996

[86] PCT No.: PCT/AU96/00726

§ 371 Date: Aug. 13, 1997

§ 102(e) Date: Aug. 13, 1997

[87] PCT Pub. No.: WO97/20700

PCT Pub. Date: Jun. 12, 1997

[30] Foreign Application Priority Data

Dec. 5, 1995 [AU] Australia ..... PN6985

[51] Int. Cl.[6] ..... B41L 1/00

[52] U.S. Cl. ..... 462/22; 462/6; 462/64; 283/116; 283/100

[58] Field of Search ..... 462/6, 22, 64, 462/65; 229/300, 301; 283/116, 101, 100

[56] References Cited

U.S. PATENT DOCUMENTS

| | | | |
|---|---|---|---|
| 883,620 | 3/1908 | Carraway . | |
| 3,062,431 | 11/1962 | Rabenold . | |
| 3,086,694 | 4/1963 | Tucker et al. . | |
| 3,111,257 | 11/1963 | Peach . | |
| 3,428,237 | 2/1969 | Dowen . | |
| 3,942,714 | 3/1976 | Wise . | |
| 4,712,729 | 12/1987 | Craig . | |
| 4,726,970 | 2/1988 | Morrish et al. . | |
| 5,052,977 | 10/1991 | Irvine | 462/6 |
| 5,088,961 | 2/1992 | Sprain | 462/901 X |
| 5,108,346 | 4/1992 | Ashby | 462/6 |
| 5,118,030 | 6/1992 | McNamara et al. | 462/6 X |
| 5,297,993 | 3/1994 | Gullett et al. | 462/6 |
| 5,346,124 | 9/1994 | Chess | 229/305 |
| 5,431,337 | 7/1995 | Bell | 229/305 |

*Primary Examiner*—Frances Han
*Attorney, Agent, or Firm*—Nixon & Vanderhye, P.C.

[57] ABSTRACT

A secure mailer/receipt business form including a top and bottom ply and at least one intermediate ply constituting a separable receipt part which receipt part is associated with image transfer material for imparting information onto the bottom ply, the rear face of the top ply including a coated adhesive material covering at least part of the surface, adhesive being coated with a releasable non-adhesive backing materials connected to the separable receipt part such that withdrawal of the separable receipt part will release the backing material to expose the adhesive layer to adhere the top ply to the top face of the bottom ply thereby sealing the top and bottom plies together after removal of the receipt part to restrict tampering with the remaining business form without damage to the form.

3 Claims, 2 Drawing Sheets

SECURE MAILER/RECEIPT BUSINESS FORM

BACKGROUND TO THE PRESENT INVENTION

Figure 1:
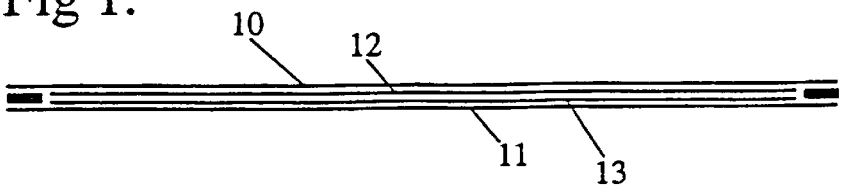

This invention relates to a combined mailer and receipt business form. The present invention relates specifically to the provision of a combined mailer receipt business form in which the receipt forms part of the return mailer, and the business form and is secured against tampering such as by alteration or obliteration in relation to information already imprinted on the receipt form.

There is a need for a security business form which includes information of a financial nature that is regulated by some government agencies, whereby accurate information about a financial transaction must be provided to the government agency for example, for taxation revenue purposes.

It is important with such documentation that the receipted amount entered into the documentation for the purposes of providing a customer receipt cannot be tampered with, altered or interfered with in any way subsequent to completion of the transaction and prior to forwarding the completed document to the government agency.

DISCUSSION OF THE PRIOR ART

Applicants are aware of the following instances of published prior art. U.S. Pat. No. 3,111,257 "Peach" teaches the provision of an envelope with a remailing arrangement. When originally opened the adhesive 30 is uncovered.

In U.S. Pat. No. 3,062,431 "Rabenold", when the envelope is snapped open the closure flap 36, with its adhesive, are uncovered.

U.S. Pat. No. 3,942,714 "Wise" discloses an envelope which contain 3 copies of a bill, the customer removing and retaining the top sheet while the return portion comprises a middle sheet. When the original envelope is opened the closure flap (with its inherent adhesive) is exposed.

In U.S. Pat. No. 883,620 "Carraway" and U.S. Pat. No. 4,712,729 "Craig" both teach tamper evident envelopes in general.

U.S. Pat. No. 3,086,694 "Tucker et al" discloses an envelope having a separate line of adhesive 17 for receiving baggage tags.

U.S. Pat. No. 3,428,237 "Dowen" teaches a remailable envelope with removable insert.

SUMMARY OF THE PRESENT INVENTION

The present invention has as an objective, the provision of a secure mailer/receipt business form which at least in part overcomes the abovementioned problems.

In one aspect, there is provided according to the present invention, a secure mailer/receipt business form comprising a top and bottom ply and at least one intermediate ply constituting a separable receipt part which receipt part is associated with image transferring material for imparting information onto the bottom ply, the rear face of the top ply including a coated adhesive material covering at least part of the surface, the adhesive being coated with a releasable non-adhesive backing material connected to the separable receipt part such that withdrawal of the separable receipt part will release said backing material to expose the adhesive layer to adhere the top ply to the top face of the bottom ply thereby sealing the top and rear plies together after removal of the receipt part to restrict tampering in a non evident manner with the remaining business form without damage to the form.

In a further aspect there is provided according to the present invention, a secure Mailer/Receipt business form comprising a top and bottom ply adhesively secured together and housing at least one removal ply, image transferring material for transferring information onto the intermediate ply and bottom ply, said removable ply being associated with a non adhesive release backing, said backing covering adhesive means on an internal surface of said business form, removal of said removable ply releasing said non adhesive backing thereby freeing the top and bottom plies to be adhered to one another by said adhesive means to prevent tamper evident opening.

Conveniently, the receipt ply includes a retained portion with a carbon patch or image transferring material for imaging on the rear face of said top ply carrying the actual receipted amount which portion is ultimately sealed against tampering upon removal of the receipt ply.

Figure 2:
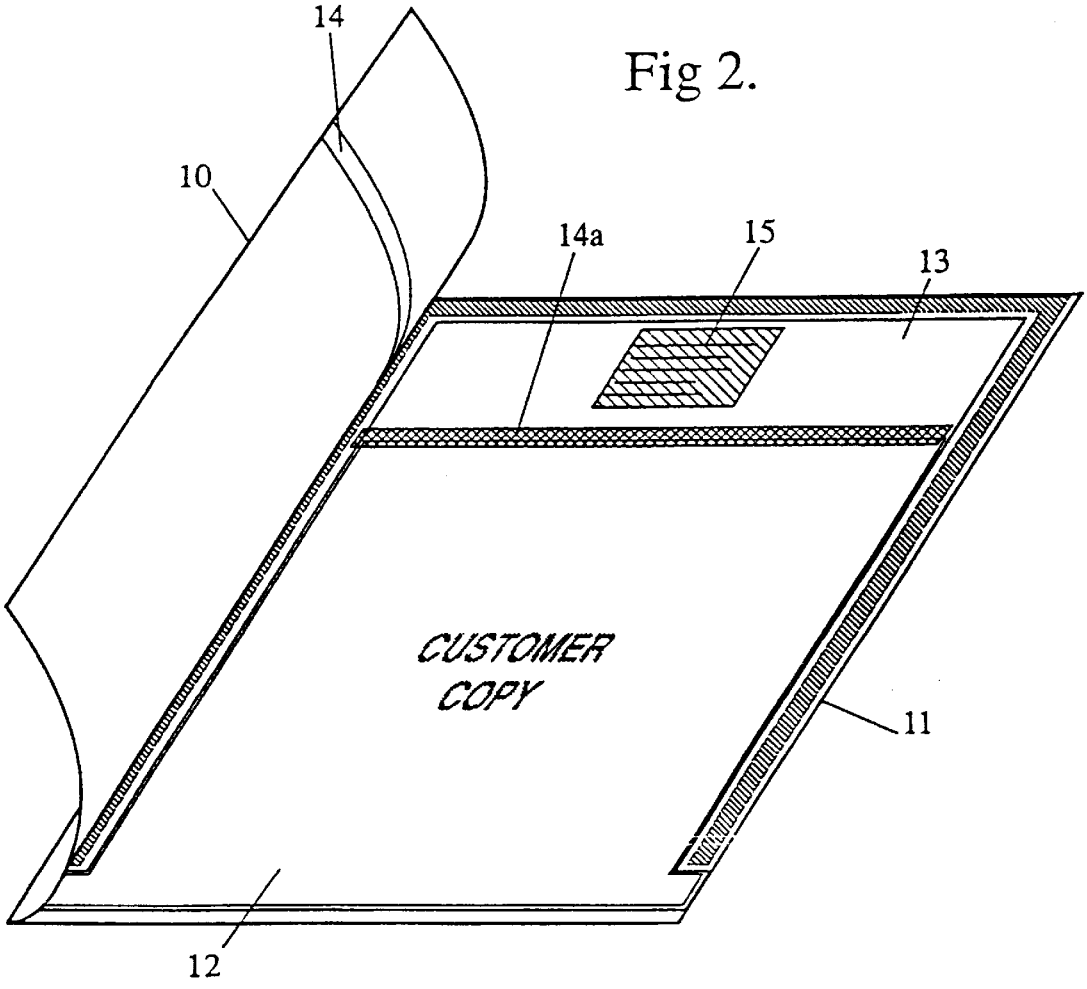
Figure 3:
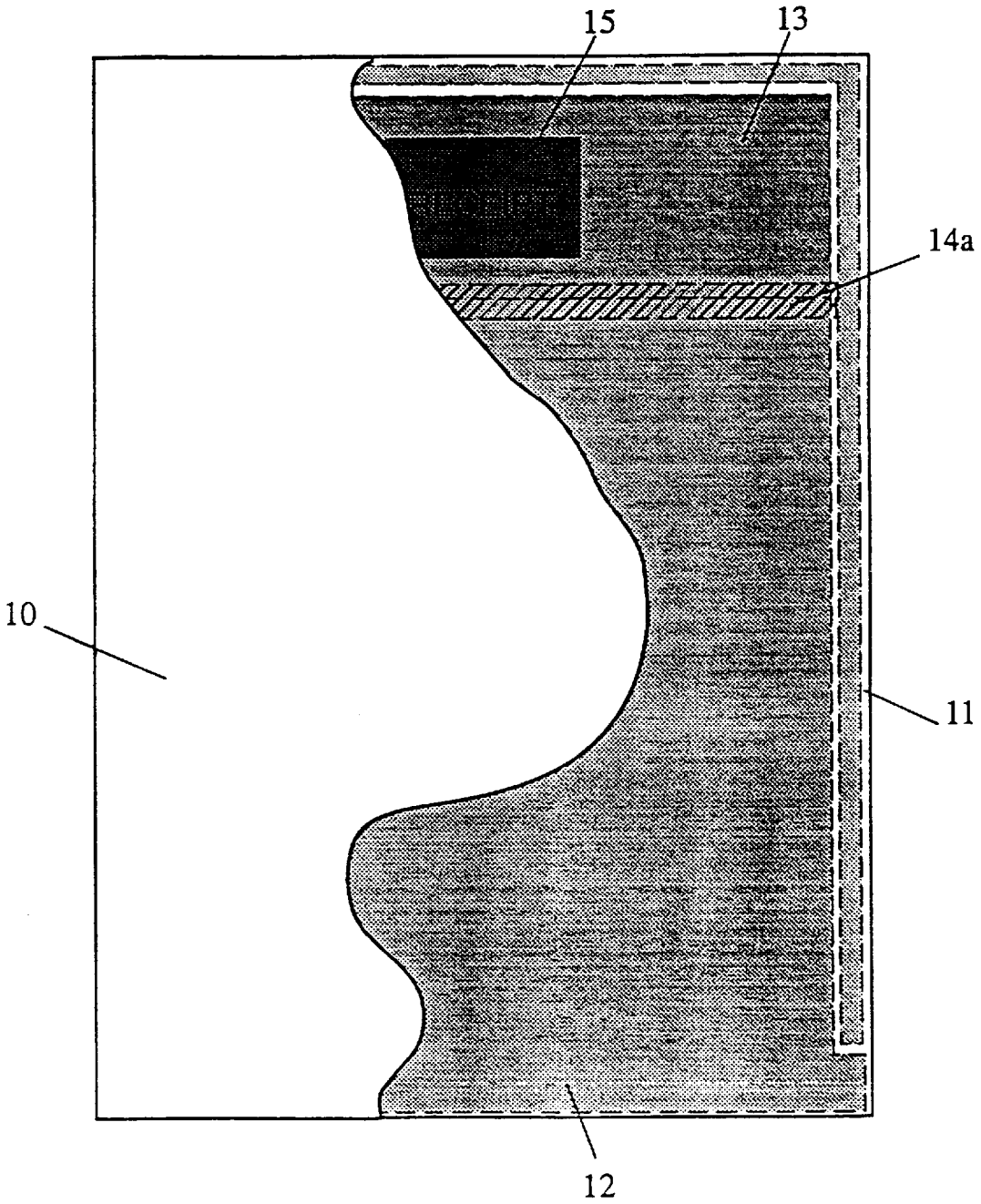

The invention will now be described with reference to the accompanying drawings in which FIG. 1 is a cross-sectional view of a secure mailer receipt business form; FIG. 2 is a partially exploded view of the secure mailer receipt form; and FIG. 2*a* is a plan view of the business form with a portion of the top ply cut away to reveal the intermediate ply.

The form includes a top ply 10 and a bottom ply 11 with one practical arrangement two intermediate plies 12 and 13.

The top ply may contain address information, for example, that of a Government agency to which the completed form must be mailed after completion of a transaction in the purchase of goods or services or the like, to which sales tax revenue may be applicable.

The business form constitutes a stack of plies as illustrated to which the receipted amount can be imprinted to provide a receipt for the customer and a copy of the receipt for the merchant.

For this purpose, the intermediate plies 12 and 13 are loosely fitted within the form and are removable from the business form, one for handing to the customer, and the other being retained by the merchant.

The rear face of the top ply 10 includes an adhesive strip 14 covered with a release strip 14*a* which is automatically uncovered as soon as the customer and/or merchant copy receipt forms 12 and 13 are removed from the business stack.

Release of the release strip 14*a* immediately frees the adhesive strip 14 for attachment to the rear ply 11 of the business form, thereby effectively sealing the contents of the business form and the information on the rear ply from access, without causing irreparable damage to the business form.

The top face of the merchant copy includes a carbon spot or image transferring material 15 which imparts a mark onto the rear face of the top ply. This mark, which may be the actual receipted amount, cannot be obliterated from the rear face of the top ply without reversibly damaging the business form.

A unique aspect of the mailer/receipt form is the after sealing of the product. That is, once the inside receipt plies have been pulled out of the mailer, the mailer is sealed automatically by adhesive of the strip 14 to the back ply 11 and cannot be tampered with without destroying the mailer. The information now imparted to the inner face or faces of the first and second plies cannot be tampered with in any way without effectively causing damage to the mailer form.

Thus, for example, alteration of the receipted amount prior to returning the form to the Government agency is not possible.

It will be appreciated that the dimensions of the mailer can be varied according to the information necessary to be placed onto the document, however, it will be appreciated that it can be of a standard envelope size.

I claim:

1. A secure mailer/receipt business form comprising a top and bottom ply and at least one intermediate ply constituting a separable receipt part which receipt part is associated with image transfer material for imparting information onto the bottom ply, the rear face of the top ply including a coated adhesive material covering at least part of the surface, adhesive being coated with a releasable non adhesive backing materials connected to the separable receipt part such that withdrawal of the separable receipt part will release said backing material to expose the adhesive layer to adhere the top ply to the top face of the bottom ply thereby sealing the top and rear plies together after removal of the receipt part to restrict tampering with the remaining business form without damage to the form.

2. A secure mailer/receipt business form comprising a top and bottom ply adhesively secured together and housing at least one removable intermediate ply, image transferring material for transferring information onto the intermediate ply and bottom ply, said removable ply associated with a non adhesive release backing, said backing covering adhesive means on an internal surface of the business form, wherein, removal of said removable ply releases said non adhesive backing thereby freeing the top and bottom ply to be adhered to one another and said adhesive means to prevent tamper evident opening.

3. A business form is claimed in claim 1 wherein the receipt ply includes a retained portion with a carbon patch or image transferring material on the rear face of said top ply carrying the actual receipted amount which portion is ultimately sealed against tampering upon removal of the receipt ply.

* * * * *